US005884116A

United States Patent [19]

Fyson

[11] Patent Number: 5,884,116

[45] Date of Patent: Mar. 16, 1999

[54] PHOTOGRAPHIC PROCESSING APPARATUS

[75] Inventor: John R. Fyson, Hackney, United Kingdom

[73] Assignee: Eastman Kodak Company, Rochester, N.Y.

[21] Appl. No.: 882,251

[22] Filed: Jun. 25, 1997

[30] Foreign Application Priority Data

Jun. 7, 1996 [GB] United Kingdom ..... 9611948

[51] Int. Cl.[6] ..... G03D 3/02

[52] U.S. Cl. ..... 396/626

[58] Field of Search ..... 396/626, 630, 396/622; 210/454; 204/237, 273, 528; 159/47.3, 7, 2.1

[56] References Cited

U.S. PATENT DOCUMENTS

| | | | |
|---|---|---|---|
| 3,995,298 | 11/1976 | Vandeputte et al. | 396/626 |
| 4,313,808 | 2/1982 | Idemoto et al. | 204/528 |
| 4,445,935 | 5/1984 | Posey et al. | 75/13 |
| 4,569,769 | 2/1986 | Walton et al. | 210/759 |
| 5,288,728 | 2/1994 | Spears et al. | 210/729 |
| 5,353,085 | 10/1994 | Kurematsu et al. | 396/626 |
| 5,526,087 | 6/1996 | Suzuki et al. | 396/572 |
| 5,678,112 | 10/1997 | Bernard et al. | 396/626 |
| 5,689,747 | 11/1997 | Jeutter et al. | 396/626 |

FOREIGN PATENT DOCUMENTS

| | | |
|---|---|---|
| 2033788 | 7/1992 | Canada . |
| 0 223 605 | 5/1987 | European Pat. Off. . |
| 0 514 868 | 11/1992 | European Pat. Off. . |
| 1 488 193 | 4/1975 | United Kingdom . |

*Primary Examiner*—D. Rutledge
*Attorney, Agent, or Firm*—Frank Pincelli

[57] ABSTRACT

A photographic processing apparatus (100) for processing photographic materials and comprising at least one processing stage (10,20), a washing/stabilizing stage (30), replenishment system (14,15,16,24,25,26,34,35,36) for replenishing each processing and washing/stabilizing stage (10,20, 30), and a treatment system (50,60,65,66,70,72) for treating effluent displaced at least from each replenished processing stage (10,20,30) during replenishment. The treatment system (50,60,65,66,70,72) comprises a collecting tank (50) in which the effluent is collected and at least one treatment chemistry holding tank (60) which contains treatment chemistry for the collected effluent. A pump head (66) controlled by a pump-motor (40) is provided for each holding tank and is used to deliver treatment chemistry to the collecting tank (50) in accordance with the amount of photographic material processed. The pump-motor (40) also controls pump heads (16,26,36) which effect replenishment of the processing and washing/stabilizing stages (10,20,30).

7 Claims, 1 Drawing Sheet

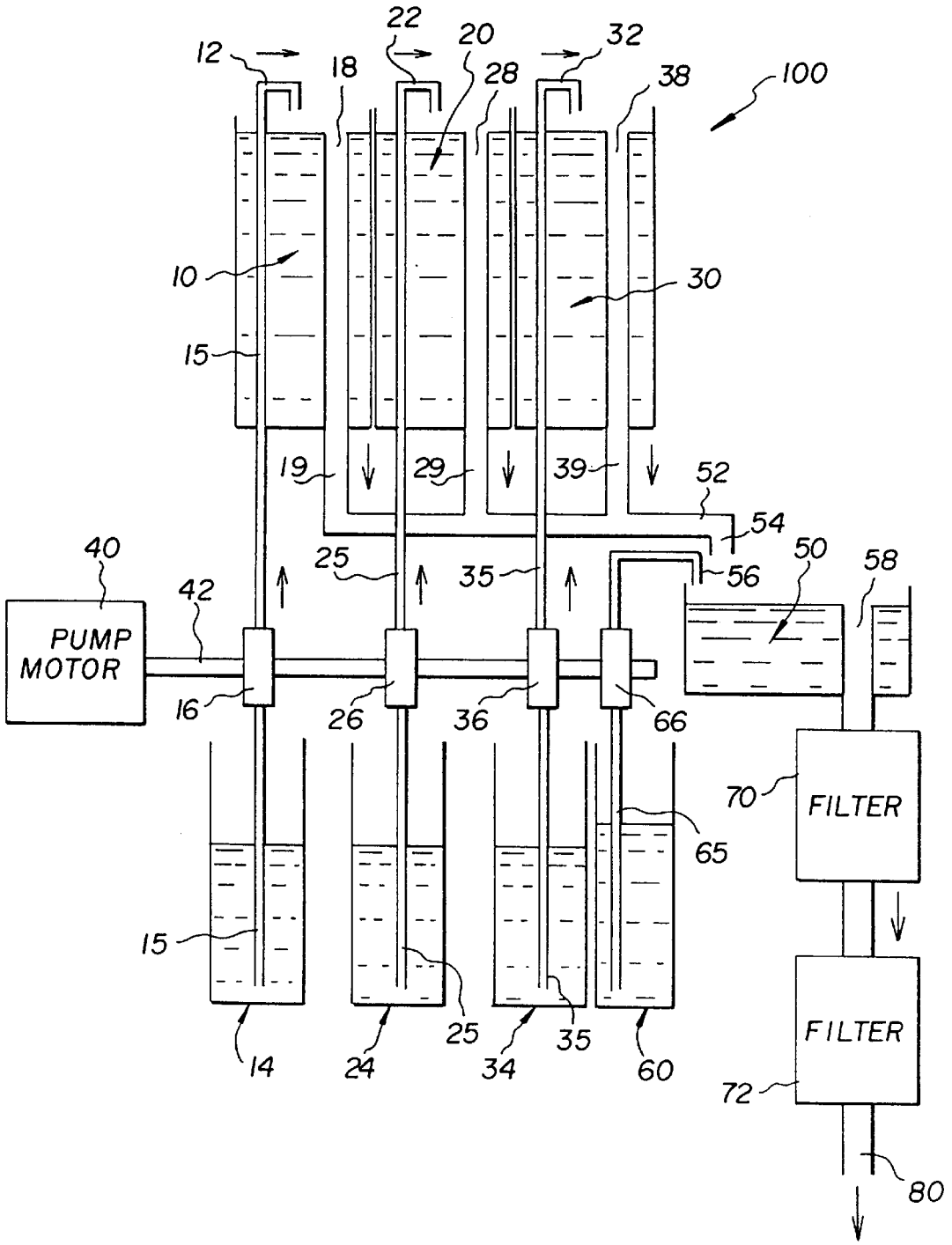
12
22
20
32
18
28
38
100
10
30
15
19
29
39
52
54
40
25
35
56
50
58
42
PUMP
MOTOR
16
26
36
66
70
FILTER
65
15
25
35
14
24
34
60
FILTER
72
80

PHOTOGRAPHIC PROCESSING APPARATUS

FIELD OF THE INVENTION

The present invention relates to improvements in or relating photographic processing apparatus, and is more particularly concerned with means for cleaning up processing chemistry in such apparatus.

BACKGROUND OF THE INVENTION

It is known to replenish the processing solutions used in photographic processing apparatus for processing photographic materials to maintain the solution activity and hence the results obtained.

It is also known to treat the processing solutions to recover silver and silver compounds therefrom. Examples of silver recovery techniques are described in CA 2 033 788, U.S. Pat. No. 4,445,935 and U.S. Pat. No. 5,288,728.

In CA 2 033 788, a process is described in which silver sulfide is recovered from a spent photographic fixer solution containing silver. A hydrosulfide reagent is introduced into the fixer solution to react with the silver in the solution so that it precipitates out as silver sulfide whilst maintaining the pH and thiosulfate levels in the fixer solution allowing it to be re-used.

U.S. Pat. No. 4,445,935 describes a method in which an alkaline hypochlorite solution is used to react with spent photographic fixer solution. Under these oxidizing conditions, the silver ion complexing agents of thiosulfate and sulfite ions are effectively destroyed. Hydrazine monohydrate is then added to the oxidizing solution to form a reducing solution to effect the formation of a precipitate of silver which is removed by filtration or decanting. The treated fixer solution can then be discharged to drain.

U.S. Pat. No. 5,288,728 describes a method of recovering silver from a mixture of seasoned photographic processing solutions, for example, seasoned stabilizer solution, bleach, bleach-fix and developer solutions, by contacting the mixture of solutions with a mercapto-s-triazine or water soluble salt thereof. The silver ion complexes with the mercapto-s-triazine compound and is allowed to settle out prior to being separated from the solutions.

EP 0 514 868 also discloses a method for processing a silver halide photographic light-sensitive material and recycling the processing solution used in the process. A silver compound is precipitated out of the processing solution using a precipitant and then removed to regenerate the processing solution for recycling.

In all of the methods described above, silver is recovered from the processing solution. However, this recovery tends to be carried out as a batch process. There is no automatic treatment of the effluent from the photographic process so that the treated processing solutions can be passed directly to drain.

Moreover, there is no disclosure of photographic processing apparatus in which the treatment of used processing solutions can be automatically carried out in conjunction with replenishment of the process.

SUMMARY OF THE INVENTION

It is, therefore, an object of the present invention to provide photographic processing apparatus in which effluent from the process carried out in the apparatus is automatically treated for disposal.

In accordance with one aspect of the present invention, there is provided photographic processing apparatus for processing photographic materials, the apparatus comprising at least one processing stage and a washing/stabilizing stage, each processing or washing/stabilizing stage having at least one processing tank containing solution for that processing stage, and replenishment means for replenishing the solution in each processing or washing/stabilizing stage, characterized in that the apparatus further comprises treatment means for treating effluent displaced from each replenished processing stage during replenishment thereof, and in that the replenishment means and the treatment means are identically controlled.

The replenishment means may comprise a plurality of replenishment holding tanks, each containing processing or washing/stabilizing solution for a respective one of the processing or washing/stabilizing stages, and supply means for supplying replenishing solution to the appropriate processing or washing/stabilizing stages in accordance with the amount of photographic material processed.

The treatment means may comprise a collecting tank for collecting effluent from at least one replenished processing stage, at least one treatment chemistry holding tank containing treatment chemistry for treating the effluent collected from each replenished processing stage, and delivery means for delivering treatment chemistry to the collecting tank for effecting treatment of the collected effluent therein.

It is preferred that the supply means and the delivery means include respective pump heads which are driven by a common pump-motor in accordance with the amount of photographic material processed.

In accordance with a second aspect of the present invention, there is provided a method of processing photographic materials in photographic processing apparatus, the apparatus comprising at least one processing stage and a washing/stabilizing stage, each processing or washing/stabilizing stage having at least one processing tank containing solution for that processing stage, and replenishment means for replenishing the solution in each processing or washing/stabilizing stage, the method being characterized by the steps of:

treating effluent displaced from each replenished processing stage during replenishment thereof, and simultaneously controlling treatment chemistry and replenishment supply to the processing stages and washing/stabilizing stages of the apparatus.

It is preferred that the effluent is treated using hydrogen peroxide, and most preferably, the hydrogen peroxide is used in the presence of a molybdate catalyst.

Advantageously, the amount of treatment chemistry supplied for treatment of the effluent from the photographic process is controlled by the same means as the processor, the amount of destruction chemistry being in proportion to the replenishment chemistry added.

In the apparatus of the present invention, only one control system is required. As the effluent is treated as it is generated and silver compounds removed, the treated effluent can be allowed direct to drain.

Moreover, the chemical oxygen demand (COD) is drastically reduced, and disposal costs are substantially reduced.

BRIEF DESCRIPTION OF THE DRAWINGS

For a better understanding of the present invention, reference will now be made, by way of example only, to the accompanying drawing, the single FIGURE of which is a schematic diagram of photographic processing apparatus in accordance with the present invention.

DETAILED DESCRIPTION OF THE INVENTION

Photographic processing apparatus in accordance with the present invention may comprise a plurality of processing stages, for example, developer, bleaching, fixer (or a bleach/fix stage replacing the separate bleaching and fixer stages) and wash/stabilizer stages and may be suitable for processing either for black-and-white or color photographic materials. Overflows produced from each processing stage, that is, the developer and fixer stages (for black-and-white and low silver color materials, that is, materials having a silver content which is less than 100 $mgm^{-2}$), and from the wash/stabilizer stage as each stage is replenished are collected together and treated with an oxidant, for example, hydrogen peroxide, in proportion to the sum of replenishment of the developer, fixer and wash, that is, the amount of solution discharged from processing stages and the wash stage during replenishment. For conventional color materials, that is, materials having a silver content which is greater than 100 $mgm^{-2}$, the fixer stage may be replaced by a bleach/fix stage. Alternatively, an additional bleaching stage may be included. The mixture may then be passed through a catalyst to accelerate the reaction and then held for a time for reaction to complete. The mixture may be filtered to remove any precipitate, particularly any silver compounds which are formed in the reaction. A carbon filter may also be include in the flow system after the chemical treatment to remove any noxious organic components.

A photographic processor 100, in accordance with the present invention, is shown in FIG. 1, and comprises a plurality of processing tanks 10,20,30, each tank 10,20,30 containing processing solution for an appropriate stage of a photographic process. In the particular embodiment illustrated, tank 10 comprises a developer stage and contains developer solution, tank 20 comprises a fixing stage and contains fixer solution, and tank 30 comprises a stabilizing or washing stage and contains a stabilizer solution or wash water. It will readily be appreciated, however, that more than one tank may be present for each of the processing stages of the photographic process. Photographic film which to be processed in the processor 100 (not shown) is passed through each of tanks 10,20,30 in turn using any suitable transport means (not shown) which is well known in the art.

Each processing tank 10,20,30 has an inlet 12,22,32 associated therewith through which replenishing chemistry can be added. Replenishing chemistry is stored in respective tanks 14,24,34 and is connected to the appropriate tank 10,20,30 by means of respective conduits 15,25,35 and pump heads 16,26,36 which are driven by a pump-motor 40 via drive shaft 42. Each conduit 15,25,35 is connected to an appropriate one of the inlets 12,24,34 as shown.

Each processing tank 10,20,30 also has an outlet 18,28,38 through which processing solution displaced during replenishment is discharged from the appropriate tank and collected in a collecting tank 50. Outlets 18,28,38 are connected to respective conduits 19,29,39 which in turn are connected to a common conduit 52 which directs the displaced processing solution to the collecting tank 50 at an inlet 54.

Pump-motor 40 is controlled by control means (not shown) so that the amount of replenishing chemistry added to each processing tank 10,20,30, via respective inlets 12,22,32, is related to the amount of photographic material which is being processed. As the solution in the tanks 10,20,30 is replenished, processing solution is displaced from each processing tank 10,20,30 and passes through outlets 18,28,38 and conduits 19,29,39 to collecting tank 50 via common conduit 52.

Treatment chemistry for the discharged processing solutions is stored in a holding tank 60 which is connected to the collecting tank 50 by conduit 65 and pump head 66. As described above with respect to pump heads 16,26,36, pump head 66 is also driven by pump-motor 40 via drive shaft 42. Conduit 65 forms an inlet 56 to collecting tank 50 as shown.

In collecting tank 50, the processing solutions which have been displaced from the tanks 10,20,30 are mixed with the treatment chemistry from the holding tank 60. As the replenishment of the processing tanks 10,20,30 and the delivery of treatment chemistry to the collecting tank 50 are effected via respective pump heads 16,26,36,66 as controlled by pump-motor 40, the ratio of treatment chemistry to the displaced or overflowed processing solution from each of the processing tanks 10,20,30 is maintained substantially constant.

In the collecting tank 50, the discharged processing solution and treatment chemistry are mixed together to react, the treated solution overflowing through an outlet 58 and then passing through filters 70,72 on its way to drain 80. Filter 70 is a carbon filter for removing organic substances and filter 72 is a mechanical filter for removing any accumulated solids which have been formed as a result of the treatment in the collecting tank 50.

It will readily be appreciated that although the present invention has been described with reference to the processing of low silver color materials, it is not limited to the processing of such materials. As mentioned above, additional processing stages, for example, a bleaching stage, may be included.

Experiments were carried out to determine the effectiveness of apparatus in accordance with the present invention.

EXAMPLE 1

A processor similar to that described above with reference to FIG. 1 was used. However, in this case, the stabilizing or washing stage did not comprise a single tank 30. Instead, four stabilizer tanks were employed which were plumbed together so that the flow of solution from one tank to the next was counter current, that is, in the opposite direction of transportation of the photographic material being processed. Replenishment was effected into the last tank of the four, that is, the last tank to receive the material being processed, and the discharge was taken from the first tank of the four, that is, the first tank to receive the material being processed, stabilizing or washing solution being overflowed from the last tank to the third, and then from the third to the second and from the second to the first. As described with reference to FIG. 1, the discharge from the first tank was collected by the collecting tank 50. All the pump heads 16,26,36,66 were driven by the same pump-motor 40. The processing solutions put in the tanks and used as replenishers are as follows:

| Developer | |
|---|---|
| Anti-Cal#5 | 0.5 g |
| Anti-Cal#8 | 0.8 g |
| dipotassium hydrogen phosphate | 40 g |
| hydroxylammonium sulphate (HAS) | 1.3 g |
| CD3 | 5.5 g |
| potassium chloride | 0.5 g |
| hydrogen peroxide (30%) | 2.7 g |
| pH adjusted to | 11.5 |

The developer solution was replenished at a rate of 163 $mlm^{-2}$ and was adjusted by altering the stroke of the relevant pump head.

| Fixer | |
|---|---|
| sodium metabisulfite | 50 g |
| sodium thiosulfate pentahydrate | 50 g |
| water to | 1 liter |
| pH adjusted to | 4.7 |

The fixer solution was replenished at a rate of 163 $mlm^{-2}$ and was adjusted by altering the stroke of the relevant pump head.

Stabilizer

EKTACOLOR PRIME stabilizer solution made up according to the recommendations on the carton and was replenished at a rate of 250 $mlm^{-2}$ and was adjusted by altering the stroke of the relevant pump head. (EKTACOLOR and PRIME are registered trademarks of Eastman Kodak Company.)

Treatment Solution

An 8% hydrogen peroxide solution was pumped at a rate of 70 $mlm^{-2}$ and was adjusted by altering the stroke of the relevant pump head.

The mechanical filter 72 which was fitted to the processor was a 13 cm string filter with a 20 $\mu$m cut off. The carbon filter 70 was a 13 cm filter supplied by 'Perforag' of Leighton Buzzard. Both these filters were replaced after every 200 $m^2$ processed.

| Process | |
|---|---|
| Solution | Time (s) |
| Developer | 45 |
| Fix 1 | 45 |
| Wash | 100(4 × 25) |

The color photographic paper processed through these solutions was a color paper with a very low silver coating weight (54 $mgm^{-2}$) which did not require bleaching to get a good color image.

The process was run at a rate so that it was possible to process approximately 10 $m^2hr^{-1}$ and the effluent collecting tank 50 held 10 l giving a 'holding time' in excess of 1 hr.

Samples of the overflow were monitored from time to time, and were analyzed using standard methods, for sulfite, thiosulfate organic carbon, silver and chemical oxygen demand (COD).

The process was also carried out with the filters removed and water replacing the treatment liquid as a control.

The average results of the analyses are shown in Table 1 below.

TABLE 1

| Component | Invention | Comparison |
|---|---|---|
| Sodium sulfite | <0.50 $gl^{-1}$ | 12.1 $gl^{-1}$ |
| Sodium thiosulfate 5HO | <0.5 $gl^{-1}$ | 12.3 $gl^{-1}$ |
| Silver | 0.6 $mgl^{-1}$ | 72 $mgl^{-1}$ |
| COD | 0.2 g $O_2gl^{-1}$ | 4.8 $O_2gl^{-1}$ |
| organic carbon | <0.1 $gl^{-1}$ | 1.8 $gl^{-1}$ |

This example shows that the effluent had a large part of the potential pollutant removed using a processor in accordance with the present invention and that no intervention by the operator was required to effect the treatment other than to charge replenishment tanks.

EXAMPLE 2

Example 1 was repeated with the exception that the holding tank 50 in the processor 100 was replaced with another filter holder. Inside this holder was placed 500 g Amberlite IRA400 anion exchange resin onto which had been adsorbed 5 g of ammonium molybdate, by stirring the resin with 5 g ammonium molybdate dissolved in 500 ml water before putting in the holder in a nylon net bag.

The use of molybdate as a treatment catalyst is described in copending U.S. patent application Ser. No. 08/795,961, filed Feb. 4, 1997 and entitled "Method of Treating Waste Effluent", which is incorporated herein by reference.

The average results of the analyses carried out are shown in Table 2 below.

TABLE 2

| Component | Invention |
|---|---|
| Sodium sulfite | <0.50 $gl^{-1}$ |
| Sodium thiosulfate $5H_2O$ | <0.5 $gl^{-1}$ |
| Silver | 0.4 $mgl^{-1}$ |
| COD | <0.1 g $O_2gl^{-1}$ |
| organic carbon | <0.1 $gl^{-1}$ |

The use of the resin reduces the volume of the process as there is no need for a holding tank and the effluent is as effectively destroyed.

More than one treatment chemical could be added, if necessary, at different times provided this addition is also controlled in the same way as the replenishment system.

The pumps for the processing chemistry and destruction technology might be physically linked either by common electrical connection or physically using the same pump motor and common drive shaft as described above.

Also in accordance with the present invention, a minimum amount of treatment chemistry can initially be added to the collecting tank 50 without measuring the amount of processing solution displaced from the processing tanks 10,20,30. The amount of photographic material which has been processed can then be determined and the additional amount of treatment chemistry required can be added by separate means (not shown) or by the pump head 66.

It is to be understood that various other changes and modifications may be made without departing form the scope of the present invention, the present invention being limited by the following claims.

| PARTS LIST | |
|---|---|
| 10,20,30 | processing tanks |
| 12,22,32 | inlets |
| 14,24,34 | tanks |
| 15,25,35 | conduits |
| 16,26,36 | pump heads |
| 18,28,38 | outlets |
| 19,29,39 | conduits |
| 40 | pump-motor |
| 42 | drive shaft |
| 50 | collecting tank |
| 52 | common conduit |
| 54,56 | inlet |
| 58 | outlet |
| 60 | holding tank |

-continued

| PARTS LIST | |
|---|---|
| 65 | conduit |
| 66 | pump head |
| 70,72 | filters |
| 80 | drain |
| 100 | processor |

What is claimed is:

1. A photographic processing apparatus for processing photographic materials, the apparatus comprising at least one processing stage and a washing/stabilizing stage, each processing or washing/stabilizing stage having at least one processing tank containing solution for that processing stage, and replenishment means for replenishing the solution in each processing or washing/stabilizing stage, characterized in that the apparatus further comprises treatment means for treating effluent displaced from each replenished processing stage during replenishment thereof, and in that the replenishment means and the treatment means are identically controlled.

2. An apparatus according to claim 1, wherein the replenishment means comprises a plurality of replenishment holding tanks, each containing processing or washing/stabilizing solution for a respective one of the processing or washing/stabilizing stages, and supply means for supplying replenishing solution to the appropriate processing or washing/stabilizing stages in accordance with the amount of photographic material processed.

3. An apparatus according to claim 1, wherein the treatment means comprises a collecting tank for collecting effluent from at least one replenished processing stage, at least one treatment chemistry holding tank containing treatment chemistry for treating the effluent collected from each replenished processing stage, and further delivery means for delivering treatment chemistry to the collecting tank for effecting treatment of the collected effluent therein.

4. An apparatus according to claim 3, wherein the supply means and the delivery means include respective pump heads which are driven by a common pump-motor in accordance with the amount of photographic material processed.

5. A method of processing photographic materials in photographic processing apparatus, the apparatus comprising at least one processing stage and a washing/stabilizing stage, each processing or washing/stabilizing stage having at least one processing tank containing solution for that processing stage, and replenishment means for replenishing the solution in each processing or washing/stabilizing stage, the method being characterized by the steps of:

treating effluent displaced from each replenished processing stage during replenishment thereof, and simultaneously and identically controlling treatment chemistry and replenishment supply to the processing stages and washing/stabilizing stages of the apparatus.

6. A method according to claim 5, wherein the effluent is treated using hydrogen peroxide.

7. A method according to claim 6, wherein the hydrogen peroxide is used in the presence of a molybdate catalyst.

* * * * *